US008083527B2

(12) United States Patent
Takeuchi et al.

(10) Patent No.: US 8,083,527 B2
(45) Date of Patent: Dec. 27, 2011

(54) BOARD-TO-BOARD CONNECTOR

(75) Inventors: Ryotaro Takeuchi, Kanagawa (JP); Taichi Taniguchi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/741,994

(22) PCT Filed: Nov. 10, 2008

(86) PCT No.: PCT/US2008/012635

§ 371 (c)(1),
(2), (4) Date: Sep. 13, 2010

(87) PCT Pub. No.: WO2009/061507

PCT Pub. Date: May 14, 2009

(65) Prior Publication Data

US 2010/0330821 A1 Dec. 30, 2010

(30) Foreign Application Priority Data

Nov. 8, 2007 (JP) ..... 2007-290527

(51) Int. Cl.
*H01R 12/00* (2006.01)

(52) U.S. Cl. ..... 439/65; 439/74

(58) Field of Classification Search ..... 439/65, 439/74, 345, 350, 353, 357, 358, 660
See application file for complete search history.

(56) References Cited

U.S. PATENT DOCUMENTS

| | | | | |
|---|---|---|---|---|
| 6,902,411 | B2 * | 6/2005 | Kubo | 439/74 |
| 7,384,274 | B1 * | 6/2008 | Chen et al. | 439/74 |
| 7,484,969 | B2 * | 2/2009 | Shiu | 439/74 |
| 2004/0014335 | A1 | 1/2004 | Igarashi et al. | |

FOREIGN PATENT DOCUMENTS

| | | |
|---|---|---|
| FR | 2 752 097 | 2/1998 |
| JP | 02-151810 | 2/1992 |
| JP | 2001-057273 | 2/2001 |
| JP | 2003-234150 | 8/2003 |
| JP | 2003-282032 | 2/2005 |

* cited by examiner

*Primary Examiner* — Tulsidas C Patel
*Assistant Examiner* — Travis Chambers
(74) *Attorney, Agent, or Firm* — Timothy M. Morella

(57) ABSTRACT

A board-to-board connector pair includes first and second intermateable connectors with each including a housing and a plurality of terminals therein. The first connector includes a first planar reinforcing locking bracket stamped from sheet metal and the second connector includes a second planar reinforcing locking bracket stamped from sheet metal and configured to mate with the first planar reinforcing locking bracket.

18 Claims, 14 Drawing Sheets

BOARD-TO-BOARD CONNECTOR

BACKGROUND OF THE INVENTION

The present invention relates to a board-to-board connector and, more particularly, to board to board connector with improved connector locking and grounding members.

Board-to-board connectors are often used for electrically connecting a pair of circuit boards arranged to be parallel to each other. Such board-to-board connector pairs are provided with one half or each pair attached to each of the mutually opposing surfaces of the pair of circuit boards. Moreover, there has been proposed a structure in which a reinforcing metal bracket attached to each of the opposite ends of each connector part is arranged as a locking member to secure each connector half to the counterpart half (for example Japanese Patent Application Laid-Open (Kokai) 2003-234150).

Referring to FIG. 14, a first connector 801 is attached to a first circuit board (not shown) and a second connector 901 is attached to a second parallel circuit board (not shown). The first connector 801 includes a plurality of first terminals (not shown) loaded in a first housing 811 made of an insulating material. The second connector 901 includes a plurality of second terminals 961 accommodated in a second housing 911 also made of an insulating material. Thus, as the first connector 801 is mated to the second connector 901 to connect the first terminals to the second terminals 961 and create the illustrated assembly, the first circuit board and the second circuit board are in turn connected to each other.

Reinforcing metallic brackets 851 are attached to the right and left sides at both ends of the first housing 811 in its longitudinal direction (a direction perpendicular to the sheet of the drawing). The reinforcing metallic brackets 851 include a tail portion 852 to be soldered to the first circuit board, a retention part 853 positioned in a slit 815 formed in the first housing 811, and an elastically deformable locking part 854 having a projection 855 formed in a tip end thereof. When the first connector 801 and the second connector 901 are mated together, the projection 855 of the locking part 854 engages a lock receiving part 915 formed on a side surface of the second housing 911. This locks the first connector 801 and the second connector 901 to each other.

SUMMARY OF THE INVENTION

An object of the present invention is, therefore, to solve the above-mentioned problems encountered by the conventional board-to-board connector pair and to provide a reliable board-to-board connector pair which includes a first and second connectors, the first connector being provided with a pair of first main bodies, each including a first locking part and a first grounding part, held on both sides of an insertion receptacle portion of a first housing. The pair of first main bodies is coupled by a connecting bar to form a first reinforcing metallic bracket attached to the first connector, and the second connector is provided with a second reinforcing metallic bracket attached thereto. The second reinforcing metallic bracket includes a second body part connecting a pair of second locking parts and includes a second grounding part. The second body part is held by an insertion plug portion of a second housing, wherein the first reinforcing metallic bracket and the second reinforcing metallic bracket are engaged with each other to exert a strong locking force, thus securing the mating state of the first connector and the second connector. The first reinforcing metallic bracket and the second reinforcing metallic bracket are also capable of serving as grounding terminals thus eliminating the need for providing separate grounding terminals and permitting the downsizing of the first connector and the second connector as well as correspondingly reducing the manufacturing cost. The first reinforcing metallic bracket is strong and is not easily disengaged from the first housing, thus ensuring reliability in its connecting performance.

In order to achieve the above-mentioned object, the present invention provides a board-to-board connector pair including a first connector provided with a first housing of a substantially rectangular parallelepiped shape in which first terminals are arranged, and insertion receptacle portions defined in both ends of the first housing and allowing first reinforcing metallic brackets to be arranged therein. A second connector is configured to be mated with the first connector and has a second housing of a substantially rectangular parallelepiped shape in which second terminals are arranged. The second housing is configured to be inserted into the first housing, and insertion plug portions connected to both ends of the second housing are configured to be inserted in the insertion receptacle portions with the insertion plug portions allowing second reinforcing metallic brackets to be arranged therein and to be engaged with the first reinforcing metallic brackets.

The first reinforcing metallic brackets include first body parts respectively to side wall parts on both sides of the insertion receptacle portion and a connecting rod-like part connecting the first body parts on both sides and each of the first body parts includes a first locking part configured to contact and engaged a second locking part of one of the second reinforcing metallic brackets. A first grounding part is provided for making a grounding connection to a board.

In the board-to-board connector in accordance with another embodiment of the present invention, the first body part includes a holding arm part connected to one end of the first grounding part, and the holding arm part pinches, together with the first locking part connected to one end of the first grounding part, a bracket holding part formed at a lower end of the side wall part from both sides. In the board-to-board connector in accordance with a further embodiment of the present invention, the holding arm part includes a holding projection protruding in a direction toward the first locking part, and the first locking part includes a holding projection protruding in a direction toward the holding arm part.

In the board-to-board connector pair in accordance with a still further embodiment of the present invention, the first locking part includes a first engaging projection formed at a position closer to a free end than the holding projection, and protruding in a direction opposite to the holding projection to be capable of being engaged with the second locking part. In the board-to-board connector pair in accordance with a further embodiment of the present invention, the connecting rod-like part includes a convex portion projecting downward.

In accordance with the present invention, the board-to-board connector pair includes a pair of first body parts, each including the first locking part and the first grounding part, held on both sides of the insertion receptacle portion of the first housing. The pair of first body portions is coupled by the connecting bar to constitute the first reinforcing metallic bracket mounted in the first connector. The board-to-board connector pair also includes second reinforcing metallic brackets attached to the second connector with the second reinforcing metallic brackets including the second body part connecting the pair of second locking parts and including the second grounding parts. The second body part is held in the insertion plug portion of the second housing. Hence, the board-to-board connector pair can be configured in such a manner that the first reinforcing metallic brackets and the second reinforcing metallic brackets are firmly mated together to exert a strong locking force thus securing the mating state of the first connector and the second connector. The first reinforcing metallic brackets and the second reinforcing metallic brackets are able to act as grounding terminals thus eliminating a need for providing separate grounding terminals and downsizing the first connector and the second connector thereby reducing the corresponding manufacturing cost. Furthermore, the first reinforcing metallic brackets can be of sufficient strength so as not to prevent disengagement from the first housing thus ensuring reliable performance.

A board-to-board connector pair includes first and second intermateable connectors. The first connector has a first housing of a substantially rectangular shape with a pair of space apart first sidewalls that define an elongated insertion receptacle with a central projection therein. A plurality of first terminal receiving cavities are spaced along the first housing and a first lock receiving cavity is located at each end of the first housing. A plurality of first terminals are provided with each first terminal being mounted in respective ones of the first terminal receiving cavities and a first reinforcing locking bracket is mounted in each of the first lock receiving cavities. The first reinforcing locking brackets are planar members that are stamped from sheet metal and include a pair of first body parts. Each of the body parts is positioned on opposite sides of the insertion receptacle and secured to one of the sidewalls and a connecting member interconnects the first body parts. Each first body part includes a first locking arm and a first board mounting part for mounting to a first circuit member.

The second connector is adapted for mating with the first connector and including a second housing of a substantially rectangular shape with a pair of spaced apart second sidewalls that define an elongated channel therebetween. The channel is configured to receive the central projection of the first connector therein. A plurality of second terminal receiving cavities are spaced along the second housing and a second lock receiving cavity is positioned at each end of the second housing. A plurality of second terminals are mounted in respective ones of the second terminal receiving cavities and are configured to operatively mate with one of the first terminals. A second reinforcing locking bracket is mounted in each of the second lock receiving cavities. The second reinforcing locking brackets are planar members stamped from sheet metal and include a pair of locking parts, a bracket retention section for securing the second locking bracket to the second housing and a second board mounting part for mounting to a second circuit member. Each of the locking parts is configured to lockingly engage one of the first locking arms of the first reinforcing locking bracket to assist in securing the first and second connectors together.

If desired, each of the first body parts may include a first retention part connected to one end of the first grounding part, and the retention part and a portion of the first locking arm of each first body part may engage opposite sides of one of the first sidewalls. The retention part and the portion of the first locking arm that engage opposite sides of one of the first sidewalls may do so at a location spaced inwardly from an outside edge of the sidewall. The retention part may include a holding projection protruding in a direction toward the first locking part, and the first locking part may include a lock projection protruding in a direction toward the retention part and may further include a deflectable locking arm for engaging one of the locking parts of one of the second reinforcing locking brackets.

If desired, the first locking part may include a first engaging projection formed at a position closer to a free end of the first locking part than the lock projection and such first engaging projection protrudes in a direction opposite to the holding projection, and engages one of the second locking arms. The connecting member may include at least one projecting portion extending downward from an edge thereof or at least two projecting portions that are spaced apart. The first and second connectors have a longitudinal axis and the reinforcing locking brackets have a thickness along the longitudinal axis. The thickness may be as thick as the sheet metal from which the first and second reinforcing locking brackets are stamped.

In one embodiment, the first and second reinforcing locking brackets mate together in a plane having a thickness as thick as the sheet metal from which the first and second reinforcing locking brackets are stamped. The first terminals are spaced along the insertion receptacle and the second terminals are spaced along the channel. The connecting member of each the first reinforcing locking bracket may be relatively narrow and deflectable and the first locking arm of the first body part may be deflectable. The locking parts of each second reinforcing locking bracket may include a deflectable arm and the bracket retention section may extend through a central bore between the sidewalls of the second connector.

DESCRIPTION OF THE PREFERRED EMBODIMENTS

Figure 1:
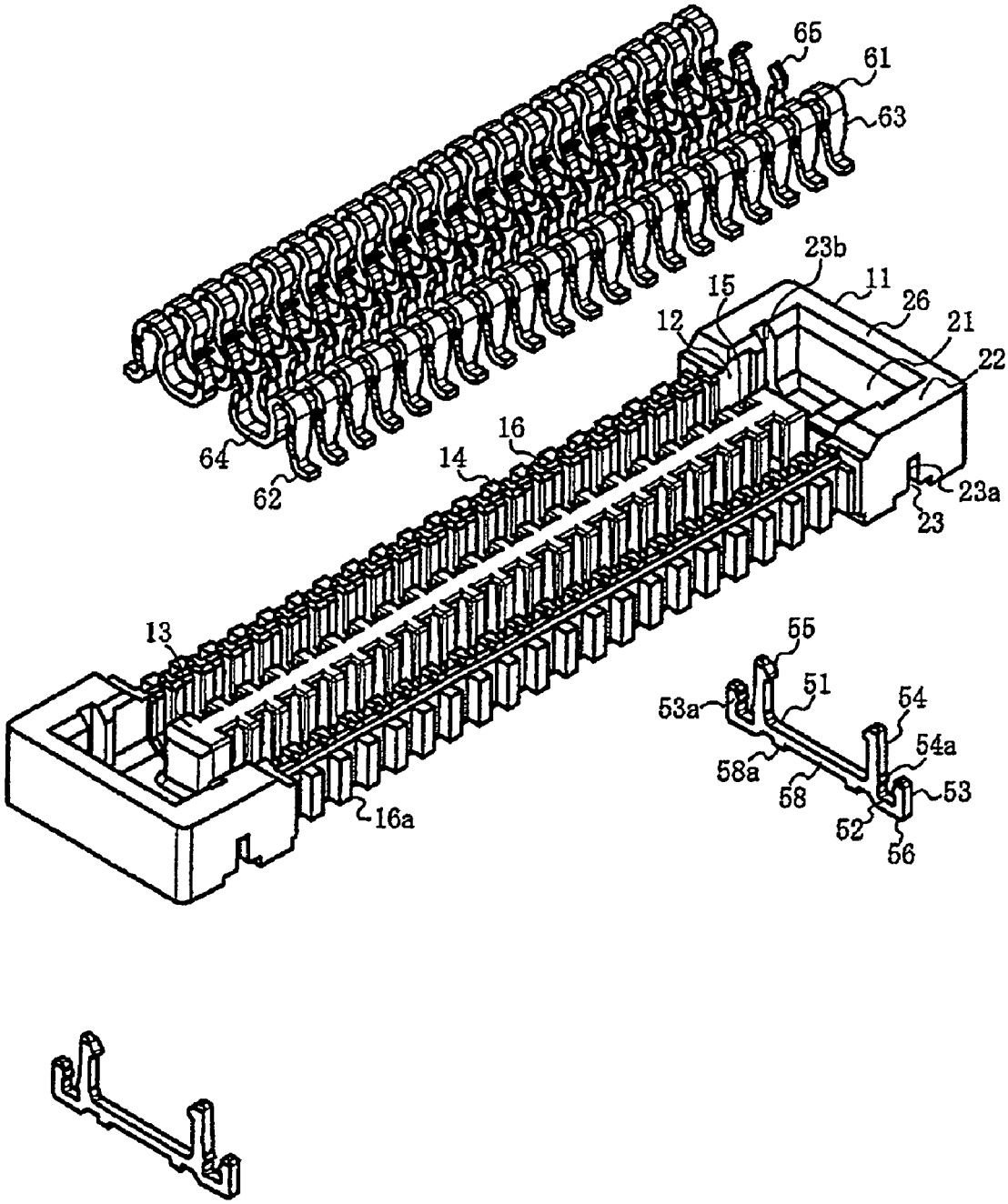
FIG. 1 is an exploded view of a first connector according to an embodiment of the present invention.
Figure 2:
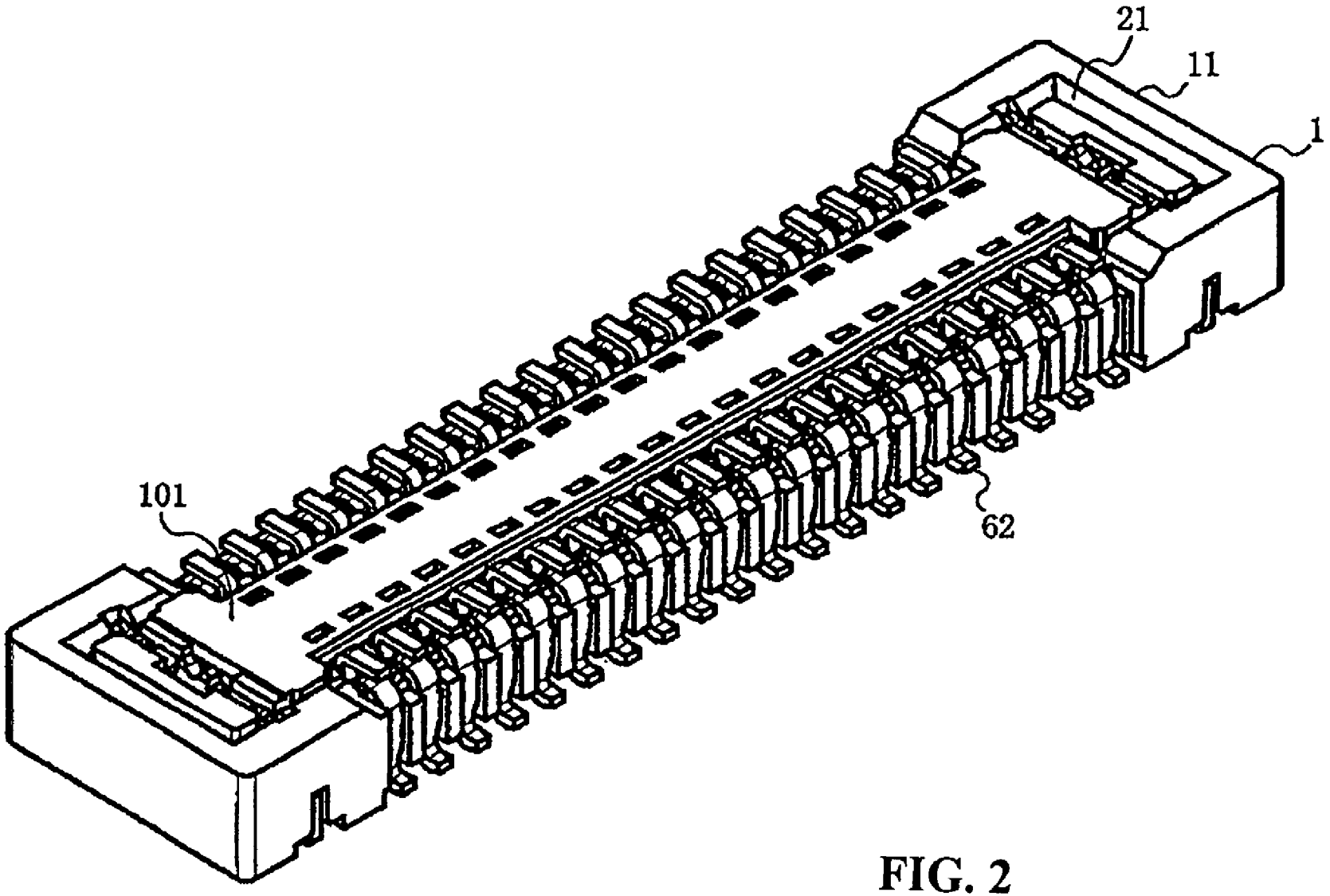
FIG. 2 is a perspective view illustrating a pair of the first and second connectors mated together, according to the embodiment of the present invention.
Figure 3:
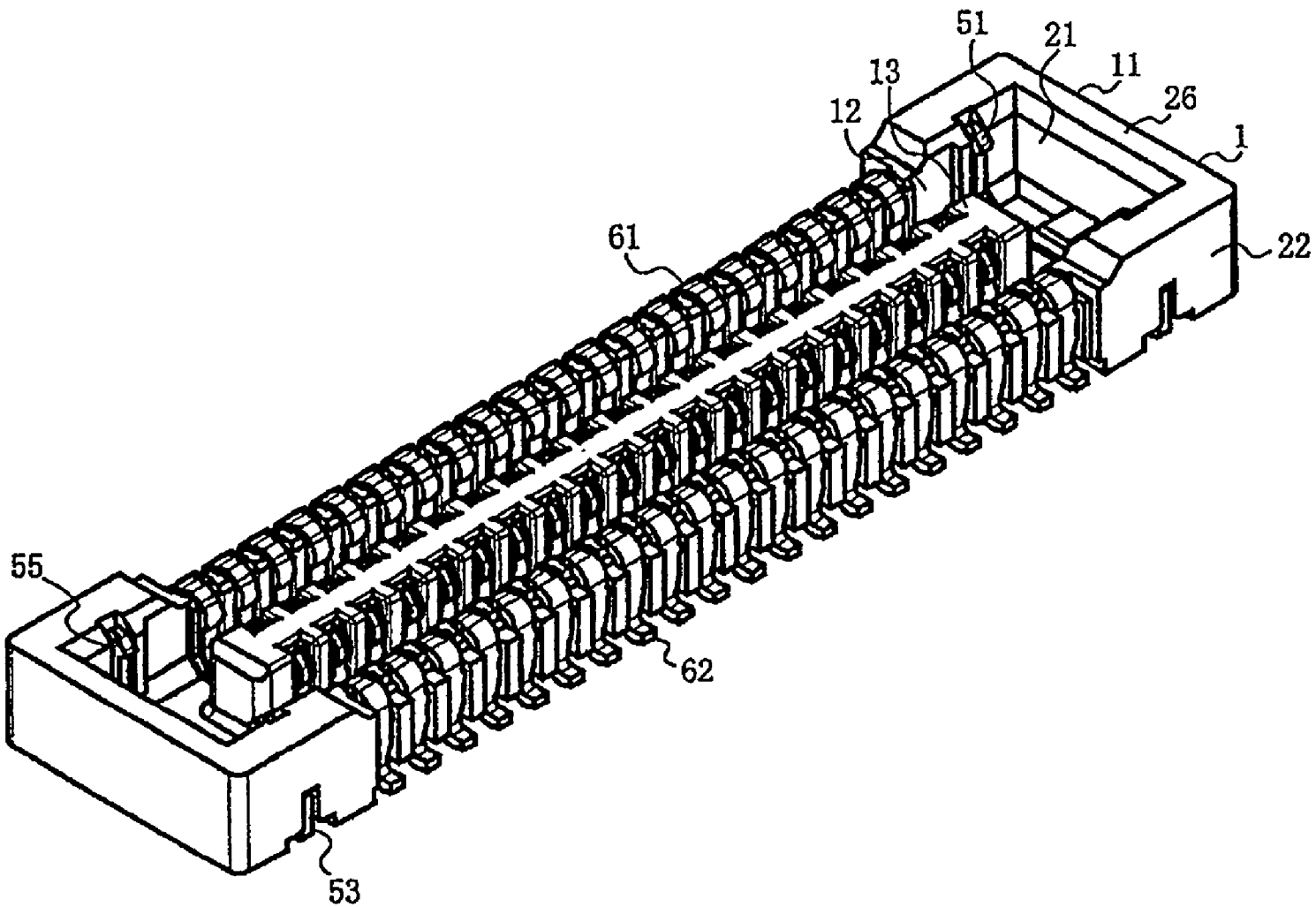
FIG. 3 is a perspective view of the first connector of FIG. 1 viewed from above the connector.

Preferred embodiments of the present invention will be described hereinbelow in detail with reference to the accompanying drawings.

Referring to FIGS. 1-9, a first connector 1 one half of a pair of surface mount board-to-board connectors according to the present embodiment and is adapted to be mounted to the surface of a first board 91 described below. A second connector is the other half of the pair of surface mount board-to-board connectors according to this embodiment and is adapted to be mounted on the surface of a second board 191 described below. The board-to-board connector pair according to this embodiment includes the first connector 1 and the second connector 101 and electrically connects the first board 91 and the second board 191 to each other through the two connectors. The first board 91 and the second board 191 are, for example, a printed circuit board used in an electronic apparatus or the like but may be a board of any type.

In this embodiment, representations of directions such as up, down, left, right, front, rear, and the like, used for explaining the structure and movement of each part of the board-to-board connector are not absolute, but relative. These representations are appropriate when each of the board-to-board connectors is in the position shown in the drawing figures. If the position of the board-to-board connectors changes, however, it is assumed that these representations are to be changed according to the change of the board-to-board connector.

Figure 4:
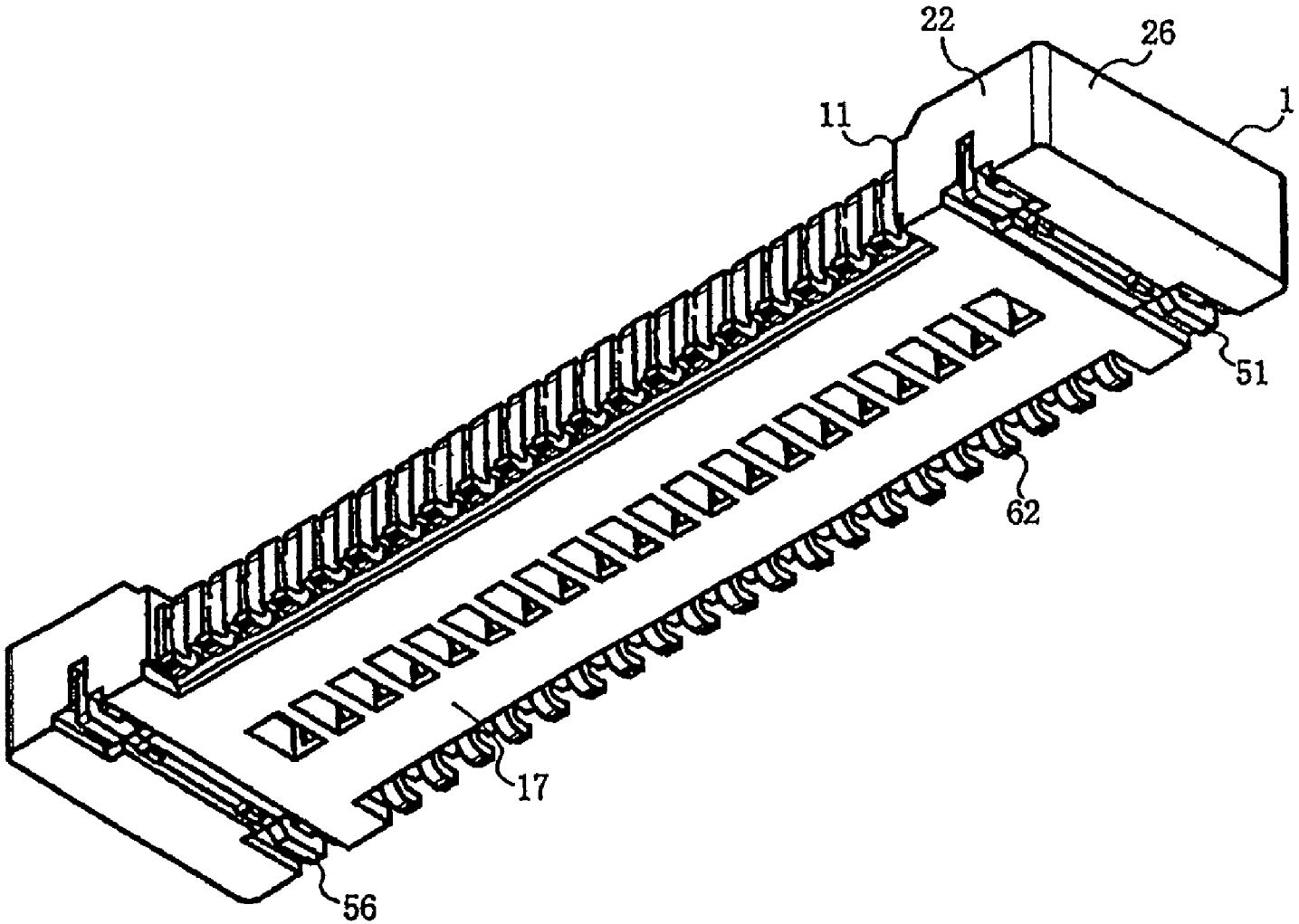
FIG. 4 is a perspective view of the first connector of FIG. 1, viewed from below the connector.
Figure 5:
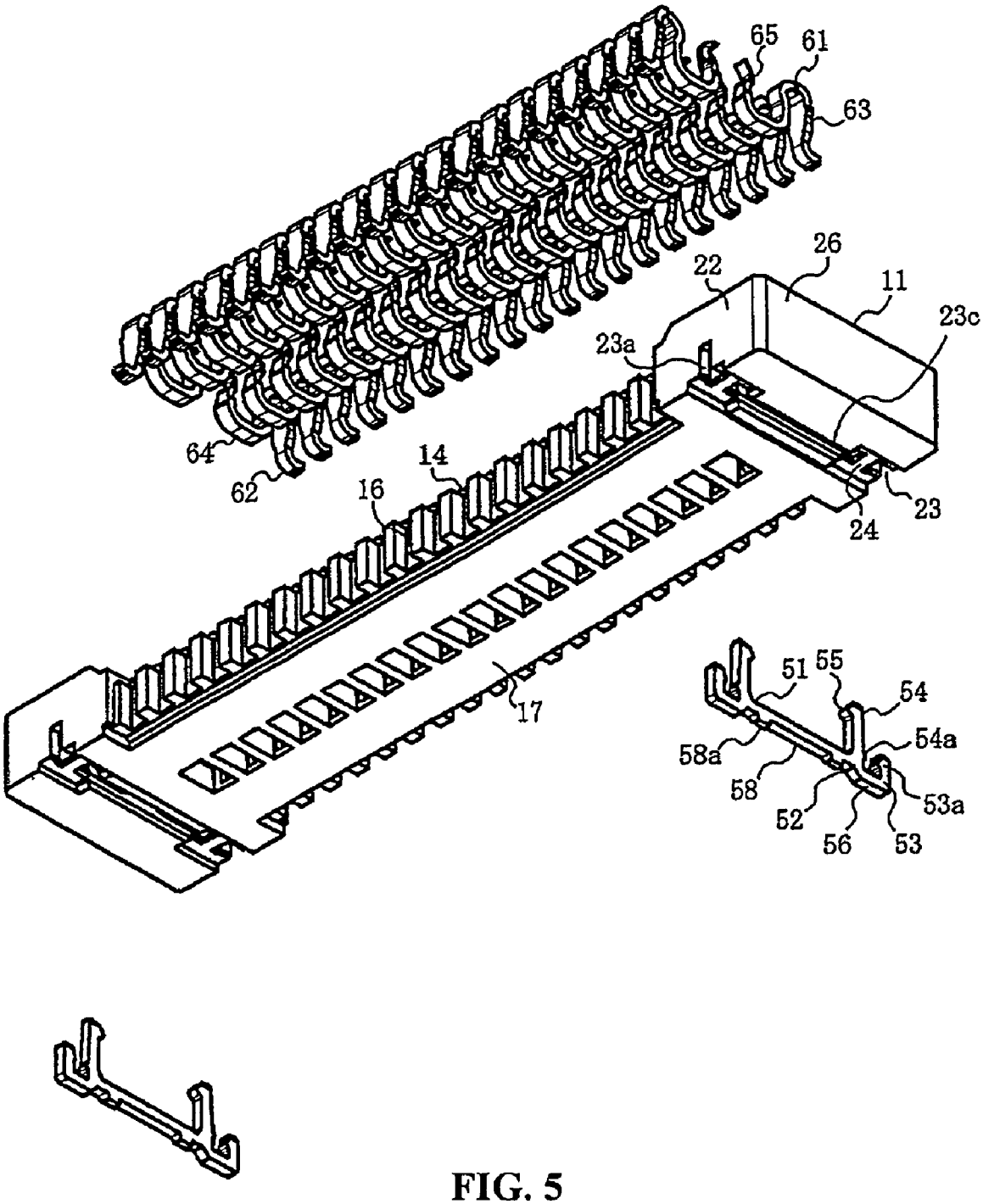
FIG. 5 is an exploded view of the first connector from the vantage point of FIG. 4.
Figure 6:
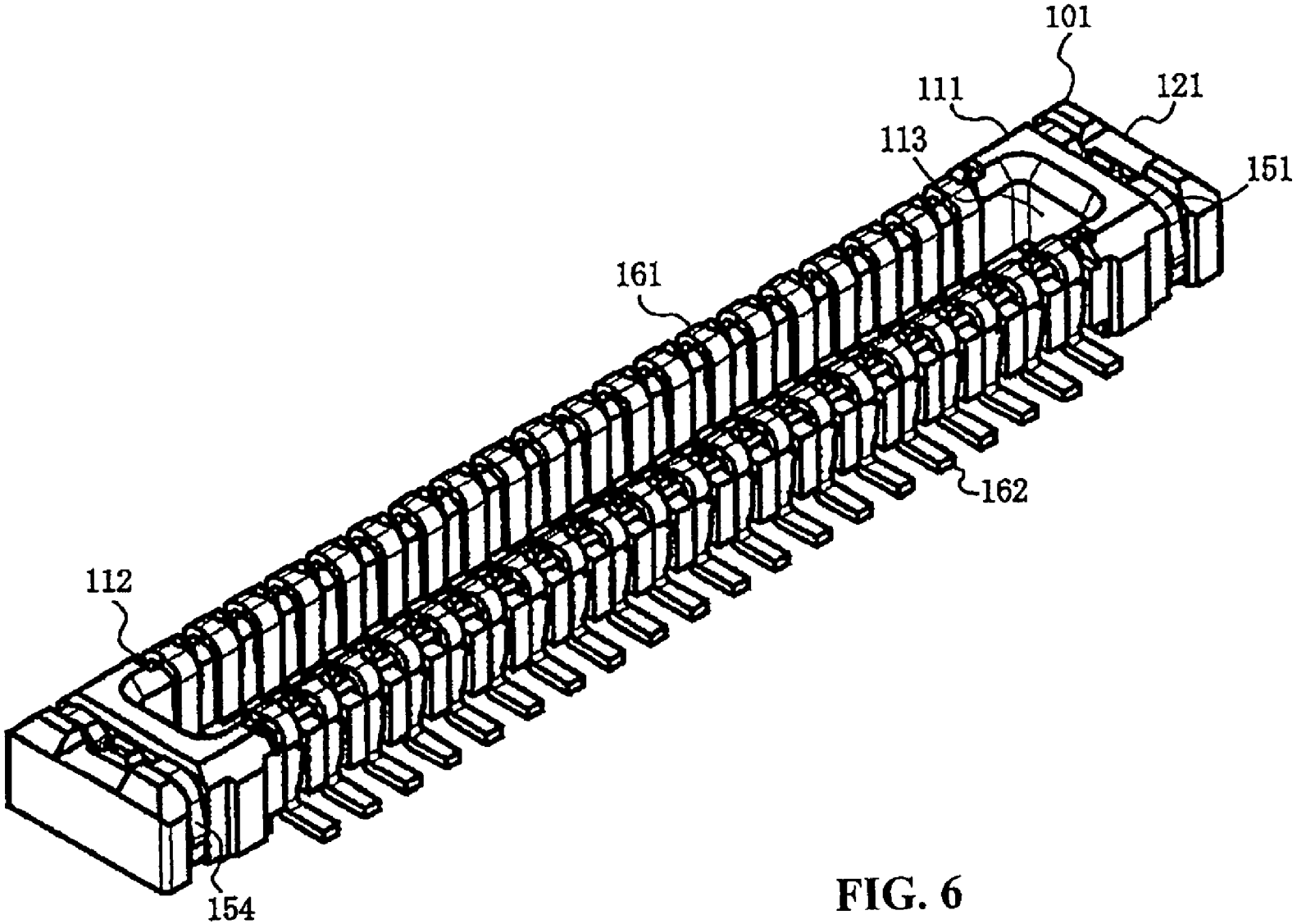
FIG. 6 is a perspective view of the second connector of FIG. 2 viewed from above the connector.

The first connector 1 includes a first housing 11 as a connector body integrally formed by an insulating material such as a synthetic resin. As illustrated, the first housing 11 has a shape of a substantially rectangular thick plate formed as a substantially rectangular parallelepiped part. The surface in which the second connector 101 is inserted, that is, the mating surface (an upper face in FIGS. 1 through 3) is formed with a receptacle portion of a substantially rectangular shape spaced inward from the outer surfaces or periphery thereof. The first connector 1 has dimensions of, for example, about 10 mm long, about 2.5 mm wide, and about 1.0 mm thick, although the dimensions may be appropriately changed as required. A central protruding portion or rib 13 is integrally formed and disposed in the receptacle portion along the longitudinal center line of the connector. Side wall parts 14 extend in parallel with the protruding portion 13 and are integrally formed integrally with the first housing 11 on opposite sides of the protruding portion 13. In this example, the protruding portion 13 and the side wall parts 14 protrude upward from a bottom surface of the receptacle portion and extend in the longitudinal direction of the first housing 11. Thus, a narrow recessed groove portion 12 as a narrow insertion receptacle portion extending in the longitudinal direction of the first housing 11 is formed between the protruding portion 13 and each of the side wall parts 14 to be disposed on each side of the protruding portion 13. As shown in FIGS. 4 and 5, each of the recessed groove portions 12 has planes one of which is closed by a bottom plate part 17 to form a mounting surface (a lower face in FIGS. 1 to 3) via which the first housing 11 is mounted on the first board 91. In the illustrated example, a single protruding portion 13 is disposed but a plurality of, or any number of protruding portions 13 may be used. The protruding portion 13 has a dimension of about 0.6 mm wide for example, although the dimension may be changed as appropriate.

First terminal receiving cavities 15, each having a recessed groove shape, are positioned along side walls 14 and extend onto both sides of the protruding portion 13 and bottom surfaces of the recessed groove portions 12 and receive first terminals 61 therein. In the example shown, there are 20 first terminal receiving cavities 15 formed with a pitch of about 0.4 mm on each side surface of the protruding portion 13 and the bottom surface of the recessed groove portions 12. The first terminal receiving cavities 15 and the first terminal receiving grooves 16 on both sides of the protruding portion 13 cooperatively function as a series of grooves receiving the first terminals 61. The pitch and the number of the first terminal receiving cavities 15, the first terminal receiving grooves 16 and the first terminals 61 may be appropriately changed as desired.

The first terminals 61 are one-piece members stamped and formed from conductive sheet metal. First terminal 61 includes a first retention portion 63 inserted into the first terminal receiving groove 16, a first tail portion 62 connected to the lower end of the first retention portion 63 and adapted for being connected via soldering or the like to a connection pad coupled to a conductive trace on a first board 91, a first connecting part or resilient beam 64 connected to the upper end of the first retention portion 63 via a bent portion and being generally U-shaped, and a first contact portion 65 formed in close proximity to a free end of the first connecting part 64 and extending inward in a direction toward the first retention portion 63. The first terminals 61 are inserted into the first terminal receiving cavities 15 and the first terminal receiving grooves 16 from the side on which the fitting surface is located, and the first retention portion 63 is pinched by the side walls 16*a* of the corresponding first terminal receiving groove 16 from both sides to secure the first terminal in the first housing 11.

End wall parts 26 of the housing 11 are arranged at opposite ends of the first housing 11 and extend transverse to its longitudinal direction. Both ends of each end wall part 26 are connected to the side wall parts 14 via end side wall parts 22 formed as side wall parts. A section of the recessed portion is located outside each end of the protruding portion 13 in its longitudinal direction and is surrounded by the end wall part 26 and the end side wall parts 22 to define an insertion receptacle portion 21. In other words, the insertion receptacle portions 21 on both sides are formed outside of the respective ends of the recessed groove portion 12. Each of the insertion receptacle portions 21 removably receives an insertion plug portion 121 of the second connector 101 described below and permanently receives first reinforcing metallic bracket or fitting nail 51 therein.

Figure 10:
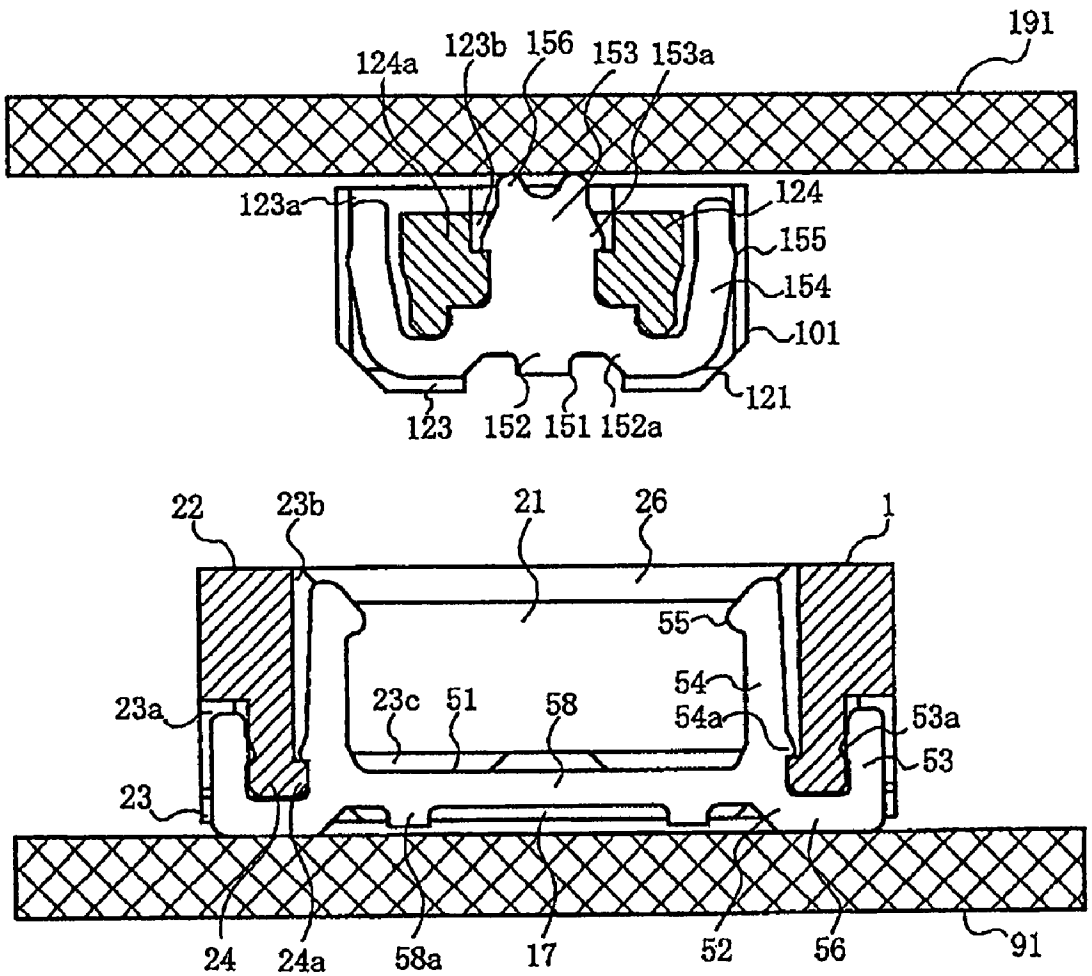
FIG. 10 is a cross-sectional view of the first connector and the second connector, illustrating the reinforcing metallic brackets thereof according to the embodiment of the present invention, in a state before mating.
Figure 11:
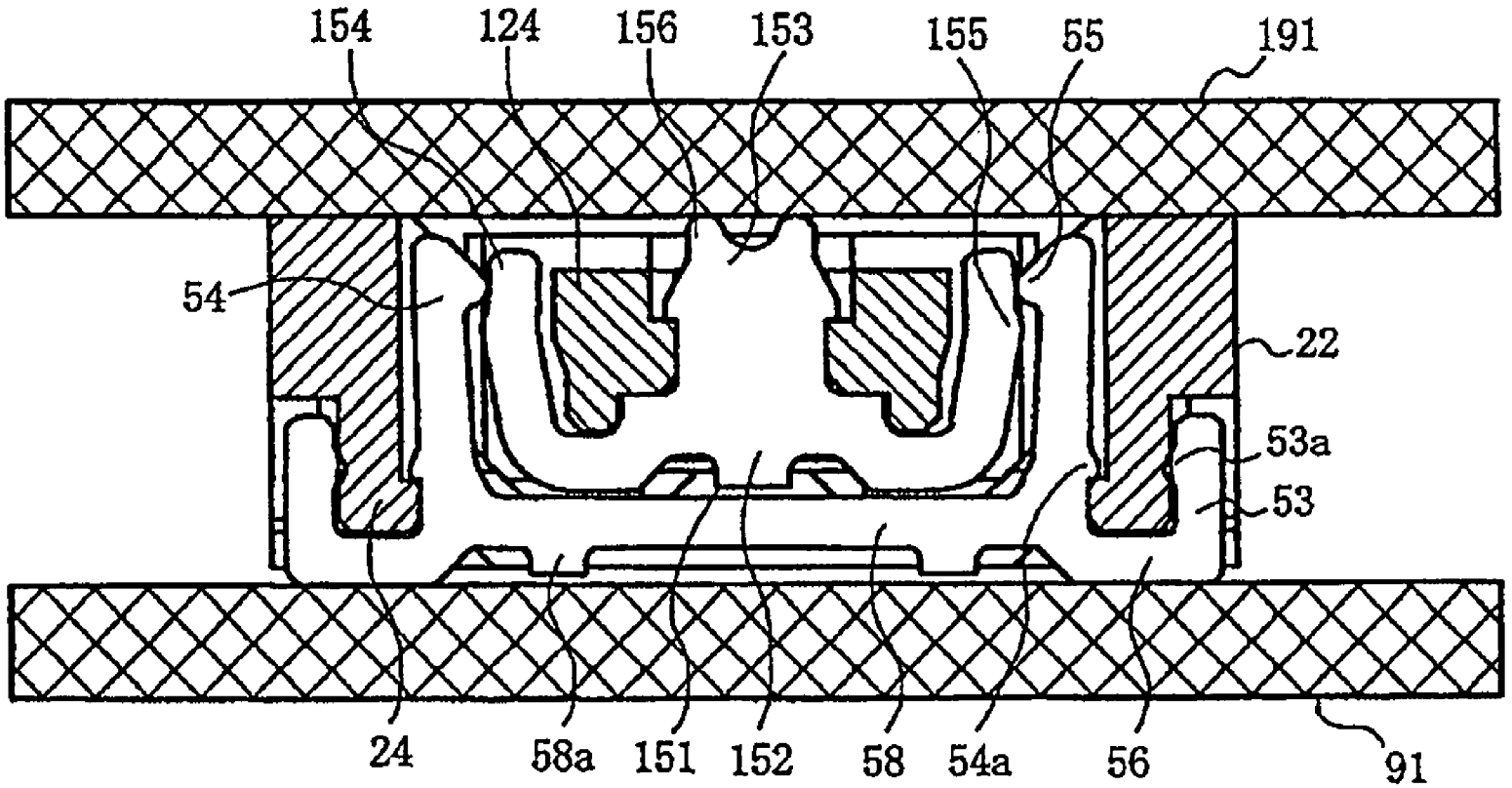
FIG. 11 is a cross-sectional view of the first connector and the second connector similar to FIG. 10, but with the connectors mated together.

Referring to FIGS. 10 and 11, the first reinforcing metallic bracket 51 includes a pair of first body parts 52 connected to both ends of connecting bar 58 which is shaped as a thin connecting rod-like part. The first reinforcing metallic bracket 51 is a one-piece member integrally formed by punching or blanking out conductive sheet metal. The first body parts 52 are held by the end side wall parts 22 at both ends of each of the opposite insertion receptacle portions 21. The first body part 52 is generally J-shaped and includes a first locking part 54, a first board mount part 56, and a retention arm 53.

The first locking part 54 extends upward (in a direction toward the mating surface of the first connector 1) from the end of the connecting bar 58 and includes a first engaging projection 55 formed in an upper end or near the free end thereof, and having a shape protruding in a direction toward the other first body part 52.

The above-mentioned first locking part 54 further includes a locking projection 54*a* formed in a portion near the base end thereof and having a shape protruding in a direction opposite to the first engaging projection 55. The locking projection 54*a* is provided to engage shoulder 24*a* of bracket described below.

The first board mount part 56 extends from the end of the connecting bar 58 in a direction away from the other first body part 52 and is formed with a lower surface thereof parallel to the lower surface of the bottom plate part 17. The first board mount part 56 is connected to a ground pad connected to a ground trace on the first board 91 by means of soldering or the like.

Retention arm 53 extends upward from the distal end of the first grounding part 56, and includes a holding projection 53*a* formed in the upper end or a portion near the free end of the holding arm part 53 and having a shape protruding in the direction toward the first locking part 54. The holding projection 53*a* grippingly engages in the outer wall surface of the bracket holding part 24. The retention arm 53 and the first grounding part 56 may be viewed as a single member having an L-shape.

The connecting bar 58 includes a projecting portion or portions 58*a* protruding downward from the lower surface thereof. While the illustrated example includes two projecting portions 58*a*, it may include only one projecting portion 58*a* or more than two projecting portions 58*a*. The size and position of each of the projecting portions 58*a* may be arbitrarily specified. Furthermore, the projecting portion 58*a* may be omitted if appropriate.

The afore-mentioned insertion receptacle portion 21 is formed with a bracket receiving receptacle portion 23, to accommodate therein the first reinforcing metallic brackets 51. The bracket receiving receptacle portion 23 includes an outer receiving section 23*a* formed on the outer surface of the end side wall part 22, in order to receive the retention arm 53 therein, an inner receiving section 23*b* formed in the inner surface of the end side wall part 22 in order to receive the first locking part 54 therein, and a connection receiving section 23*c* extending in the lateral direction of the first housing 11 formed in the bottom plate part 17, in order to receive the connection bar 58 therein.

Figure 7:
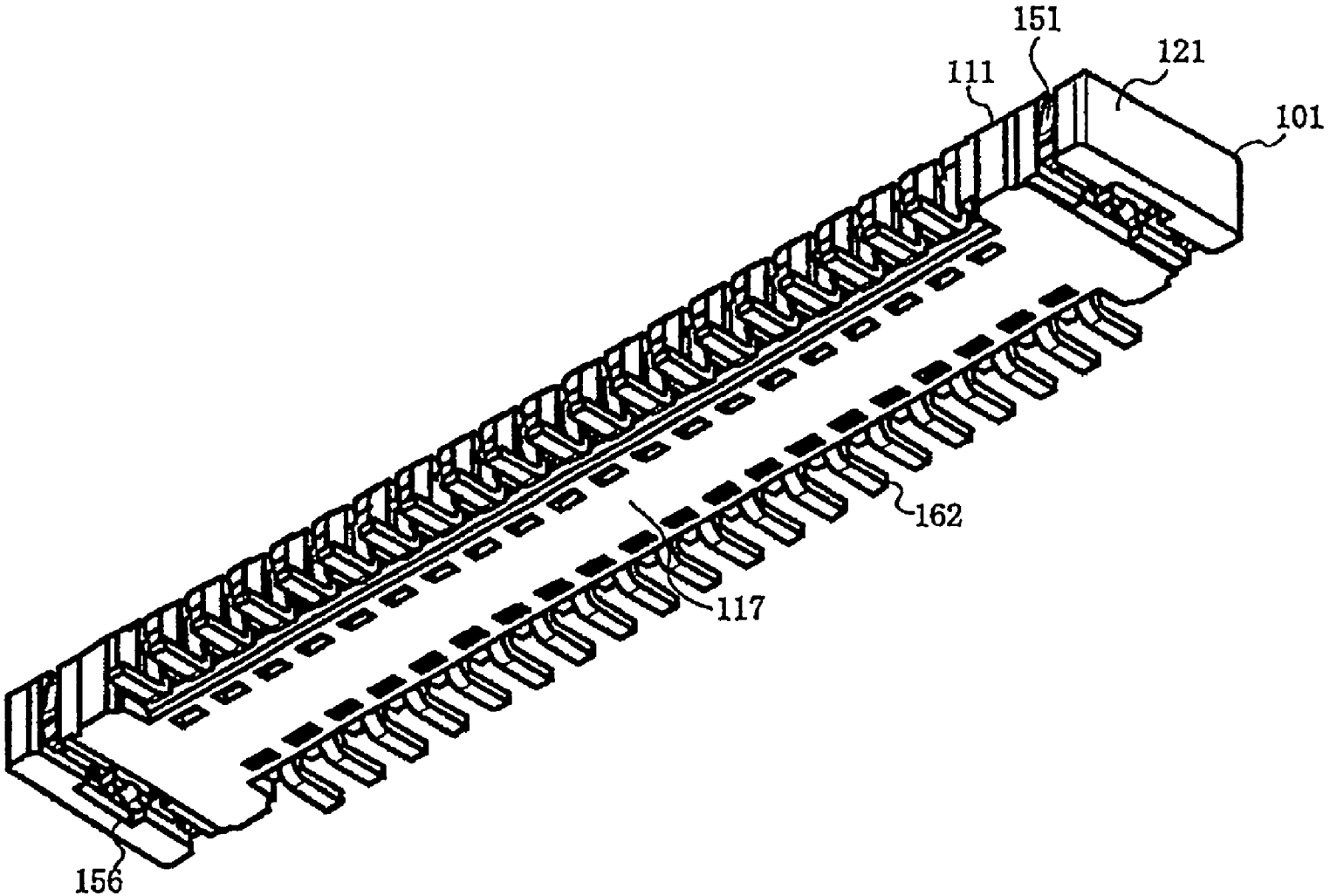
FIG. 7 is a perspective view of the second connector of FIG. 2 viewed from below the connector.
Figure 8:
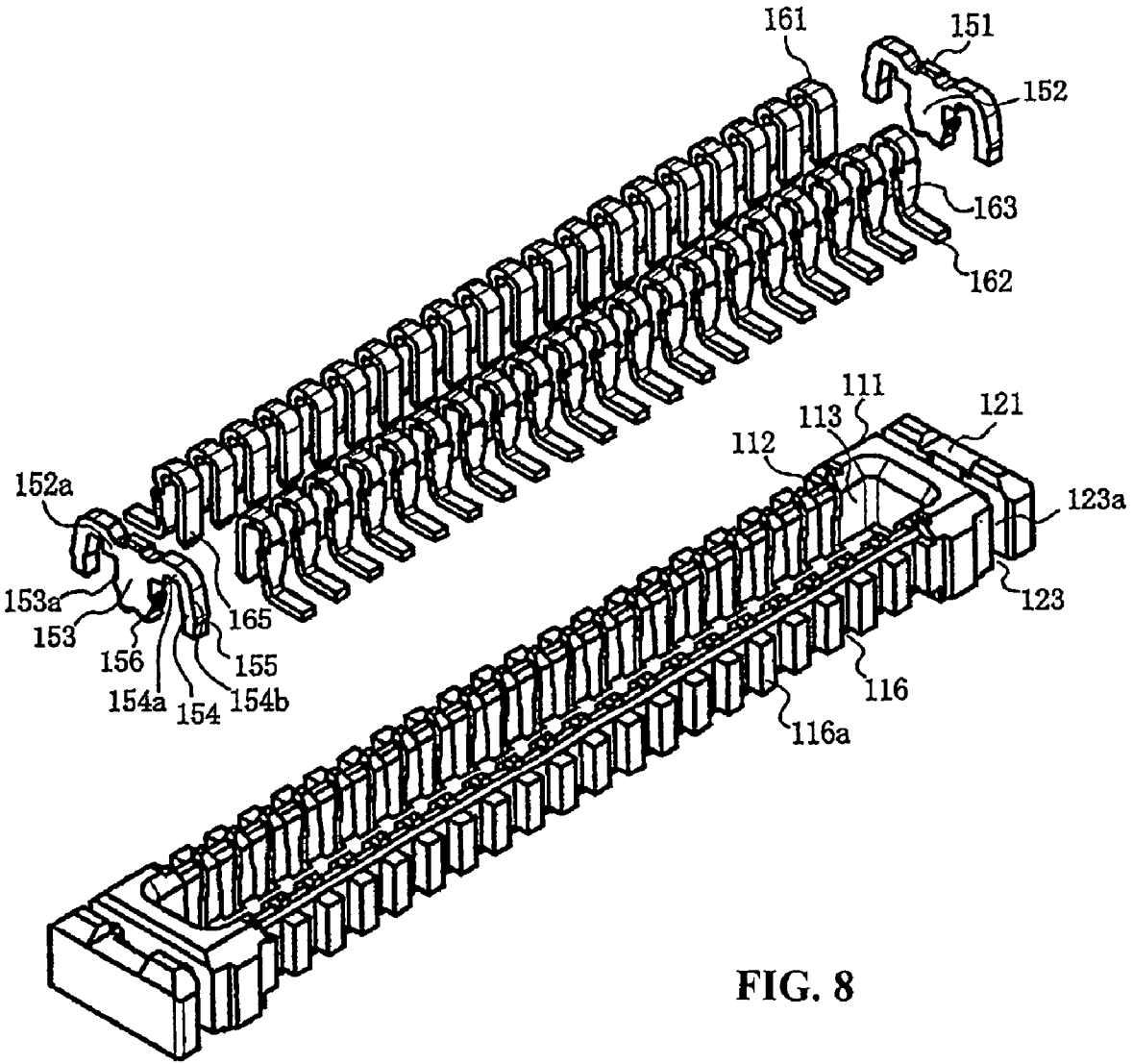
FIG. 8 is an exploded view of the second connector of FIG. 2.
Figure 9:
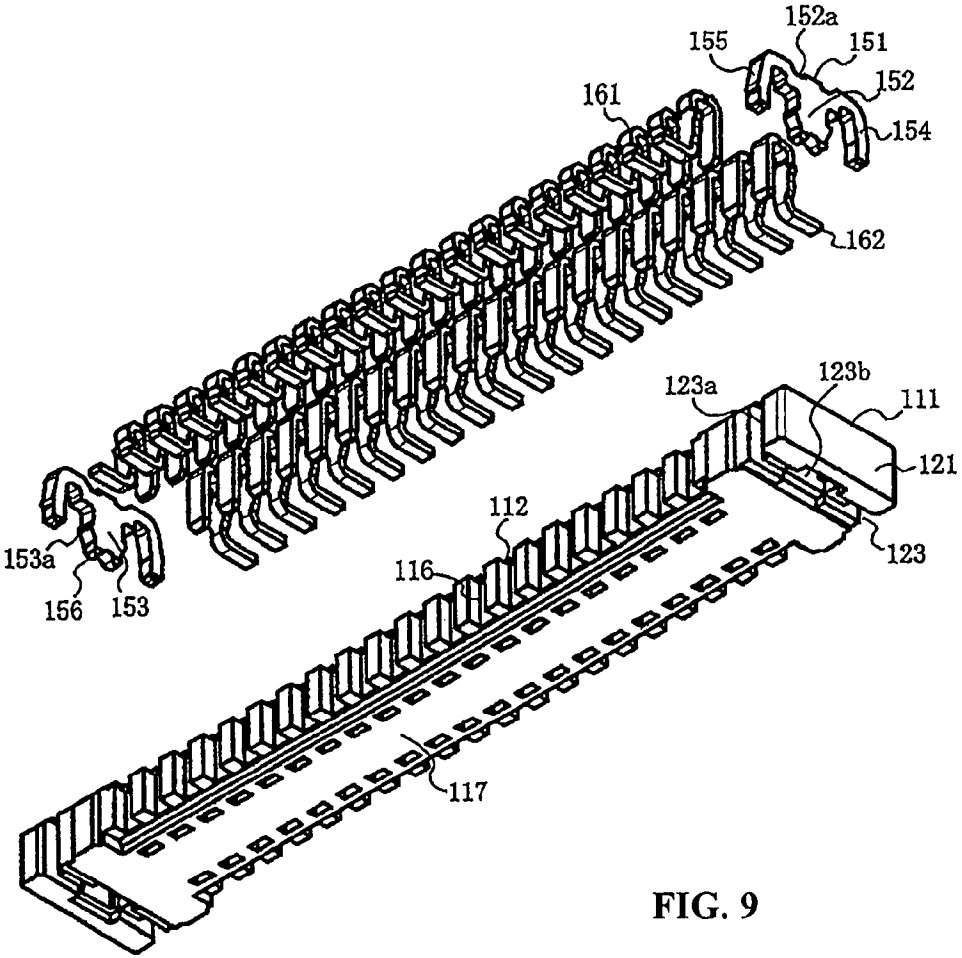
FIG. 9 is an exploded view of the second connector from the vantage point of FIG. 7.

The second connector 101 includes a second housing 111 formed as an integral connector body formed of an insulating material such as a synthetic resin. As illustrated in FIGS. 6-9, the second housing 111 has a shape of a substantially rectangular thick plate formed in a substantially rectangular parallelepiped member. The exemplary dimensions of the second housing 111 are about 10 mm long, about 1.5 mm wide, and about 0.8 mm thick, although the dimensions may be changed as required. The second housing 111 is formed with a face thereof configured to be mated to the first connector 1. That is, the mating face (an upper face in FIGS. 6 and 8) has protruding portions integrally formed and extending in the longitudinal direction relative to the second housing 111. The protruding portions 112 are formed along each of the sides of the second housing 111. As shown in FIGS. 7 and 9, the recessed groove portion 113 has a plane closed by a bottom plate part or face 117 to form a mounting surface (a lower face in FIGS. 6 and 8) to be mounted on the second board 191. While two protruding portions 112 are arranged in the illustrated example, a single protruding portion 112, or any number of protruding portions 112 may be arranged as required. The recessed groove portion 113 has a dimension of about 0.7 mm wide for example, although the dimension may be appropriately changed as necessary.

Second terminal receiving grooves 116 having a recessed groove shape are formed in both side surfaces of the protruding portions 112 and extend across the top for the purpose of receiving therein second terminals 161. As depicted, twenty second terminal receiving grooves 116 are arranged, for example, with a pitch of about 0.4 mm on each protruding portion 112 and the top thereof. The pitch and the number of the second terminal receiving grooves 116 and second terminals 161 may be appropriately changed as necessary.

The second terminals 161 are one piece members stamped and formed from conductive sheet metal. Second terminal 161 includes a second retention portion 163 inserted into the second terminal receiving groove 116, a second tail portion 162 connected to the lower end of the second retention portion 163 and adapted to be connected by soldering or the like to a connection pad coupled to a conductive trace on a second board 191, and a second contact portion 165 connected to the upper end of the second retention portion 163 via a downwardly extending bent portion. The second terminals 161 are inserted into the second terminal receiving grooves 116 from the side on which the mating face is located, and the second retention portion 163 is pinched by both side walls 116*a* of the second terminal receiving groove 116 to secure the second terminal 161 in place.

End wall parts 121 are arranged at both ends of the second housing 111 and extend lateral to the housing's longitudinal direction. Both ends of the end wall parts 121 are connected to the protruding portions 112, respectively. End wall parts 121 are configured t be inserted into the insertion receptacle portions 21 of the first connector 1 when the two connectors are mated together.

The second reinforcing metallic bracket or fitting nail 151 includes a second body part 152, a pair of second locking parts 154, second grounding parts 156, and a retention portion 153. The second reinforcing metallic bracket 151 is a one-piece M-shaped member formed of a conductive sheet metal by blanking. The second reinforcing metallic bracket 151 is formed so that the second body part 152 thereof is retained at the end wall part 121.

The second locking part 154 is an L-shaped member connected to shoulders 152*a* at both upper ends of the second body part 152 and is provided with a horizontal portion 154*a* extending outward in parallel to the afore-mentioned bottom plate part 117, and a vertical portion 154*b* connected to the horizontal portion 154*a* and extending downward. The second locking part 154 is further provided with a second engaging arm or projection 155 of an outwardly projecting shape formed near the free end of the vertical portion 154*b*.

The second body part 152 includes a retention portion 153 having outwardly projecting holding projections or barbs 153*a*. The holding projections 153*a* are adapted to engage the holding shoulders 124*a* of bracket holding part 124 formed in the insertion plug portion 121.

The second grounding parts 156 extend downward from the lower end of the retention portion 153, and are connected by means of soldering or the like to a grounding pad coupled to a ground trace on a second board 191.

A bracket receiving receptacle portion 123 is formed in the end wall part 121 and receives therein the second reinforcing metallic bracket 151. The bracket receiving receptacle portion 123 has an outer receiving part 123*a* formed in a top portion and both outer side surfaces of the end wall part 121 in order to receive the second locking part 154, and an inner receiving part 123*b* extending through end wall part 121 and configured to receive therein the holding barrel portion 153.

As shown in FIG. 10, the first reinforcing metallic bracket 51 is secured to the first housing 11 through an interference fit on both sides between the bracket holding parts 24 and the first locking part 54 of each of the first body parts 52. That is, the first body parts 52 are inserted into the first housing 11 from below, and each of the bracket holding parts 24 on both sides between the corresponding holding arm part 53 and first locking part 54, so that the first reinforcing metallic bracket 51 is attached to the first housing 11.

The holding projection 53*a* of each holding arm part 53 is engaged with and grips in the outer wall surface of the bracket holding part 24, and the holding projection 54*a* of the first locking part 54 is engaged with the holding shoulder 24*a* of the bracket holding part 24. Thus, even when a force to pull up the first housing 11 upward with respect to the first reinforcing metallic bracket 51 is exerted, the first housing 11 does not come out of the first reinforcing metallic bracket 51. The bracket holding part 24 on each side is pinched by the holding projection 54*a* of the first locking part 54 and the holding projection 53*a* of the holding arm part 53. Moreover, the holding projection 54*a* and the holding projection 53*a* are formed by a single continuous plate material. Thus, the first reinforcing metallic bracket 51 remains fixed to the first housing 11 even when a force in the lateral direction of the first housing 11 (in the right and left direction in FIG. 10) such as tilting or vibration is exerted on the first housing 11. By connecting the first grounding part 56 of the first reinforcing metallic bracket 51 to the grounding pad on the first board 91 by means of soldering or the like, the first housing 11 is firmly and fixedly secured to the first board 91.

The lower surface of the first grounding part 56 is flat and thus comes into contact with and is connected to the grounding pad on the first board 91 over a broad area and accordingly, a large bonding force is provided between the first grounding part 56 and the first board 91. Thus, even when a large force is exerted on the first reinforcing metallic bracket 51, no separation of the first reinforcing metallic bracket 51 from the first board 91 occurs. The distal end of the first grounding part 56, that is, the end of the first grounding part 56 opposite to the connecting bar 58 is located inward from the outer surface of the end side wall part 22. That is, the first grounding part 56 is arranged so as not to outwardly protrude from the outer surface of the end side wall part 22. This arrangement makes it possible to reduce the dimension of the first connector 1 in the width direction and that of the width of a mounting surface necessary for mounting the first connector 1 on the first board 91. Moreover, the holding arm part 53 connected to the distal end of the first grounding part 56 is also accommodated within the outer receiving part 23*a* recessed in the outer surface of the end side wall part 22. This makes it possible to contribute to the reduction in the dimension in width direction of the first connector 1.

Further, the right and left first body parts 52 attached to the right and left end side wall parts 22 of the first housing 11 are connected together to become one integral part by the connecting bar 58, which prevents the distortion of the first housing 11. The above-mentioned integral one part structure of the right and left first body parts 52 allows the right and left first body parts 52 to be easily mounted onto the first housing 11 at an improved mounting accuracy, compared with a case where the right and left first body parts 52 are left separate from each other.

In addition, at a time when the first connector 1 and the second connector 101 are mated to one another, or in a state they have been mated together, the right and left first body parts 52 are naturally subjected to being bent while being expanded. In this process, an outward force is exerted on each of the first body parts 52, which produces an elongation stress in the connecting bar 58. The elongation stress also acts on the first body parts 52. This fact enables it to firmly maintain the fitting of the first connector 1 to the second connector 101 without upsizing the first body parts 52.

The connecting bar 58 is provided with the convex portions 58*a* integral with the bar 58 per se, which are arranged to protrude downward from the lower surface of the connecting bar 58. These convex portions 58*a* function as a reinforcing member, respectively, and are able to enhance the strength of the connecting bar 58. While it might be possible to enhance the strength of the connecting bar 58 by increasing the dimension of width (the vertical dimension in FIG. 10) of the entire connecting bar 58, an increased amount of material must be consumed as the connecting bar 58 thus adding to the manufacturing cost of the first reinforcing metallic bracket 51. To the contrary, by forming each convex portion 58*a* of a necessary size in an appropriate portion of the connecting bar 58 to obtain necessary strength, it is possible to minimize an increase in the amount of material consumed for producing the connecting bar 58 thereby suppressing the manufacturing cost of the first reinforcing metallic bracket 51. It is possible to adjust the strength of the connecting bar 58 by adjusting the number, arrangement and size of convex portions 58*a*. This allows arbitrary setting of the strength of the connecting bar 58. At this stage, the connecting bar 58 does not require precise dimensional accuracy unlike the other parts. It is thus possible to arrange and produce the convex portion or portions 58*a* as a carrier means for transferring the reinforcing metallic bracket 51 in the stage of production thereof and assume the same as a section to be cut.

Figure 12:
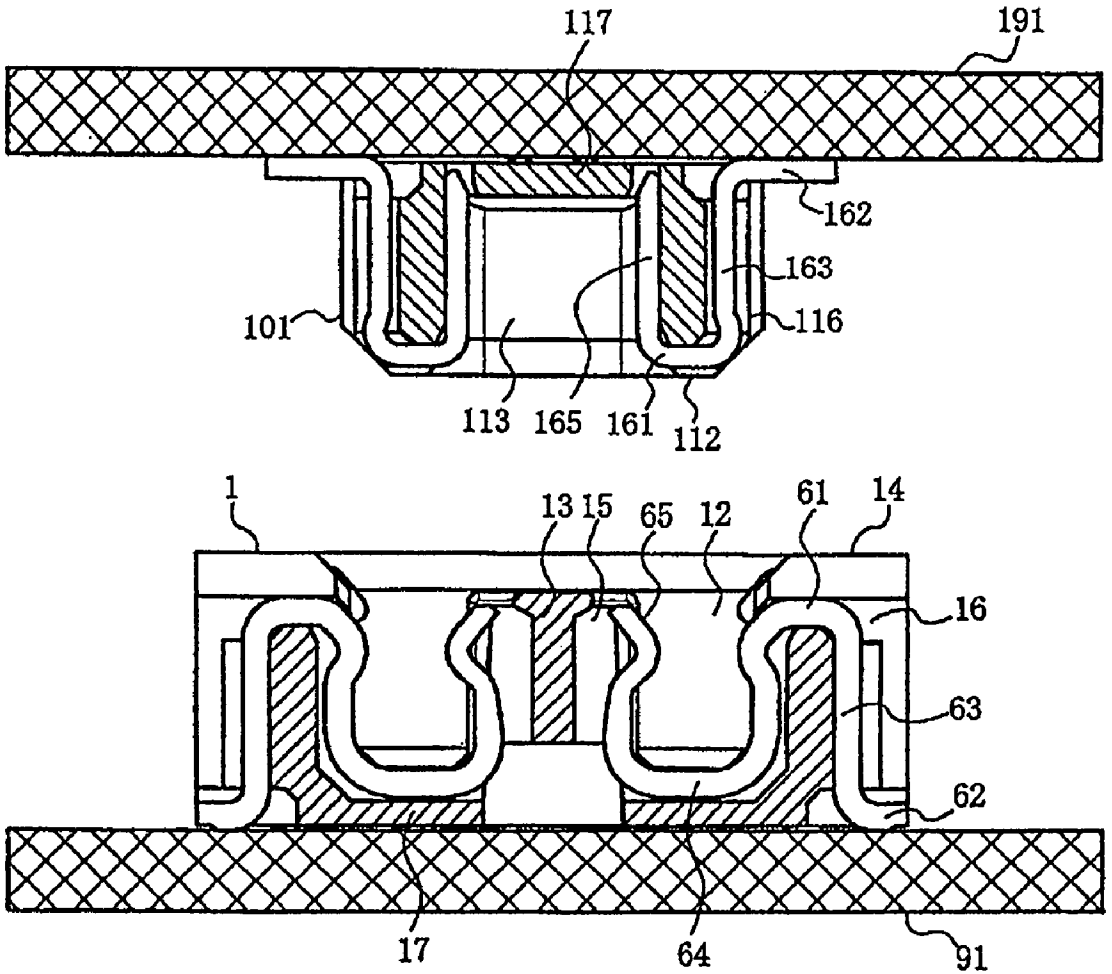
FIG. 12 is a cross-sectional view of the first connector and the second connector, illustrating the terminals thereof according to an embodiment of the present invention, before the connectors are mated together.

The above-mentioned convex portion 58*a* is desirably formed to protrude downward so that the lower end of the convex portion 58*a* will not be in contact with the upper surface of the first board 91. This keeps any portion of the connecting bar 58 to be separated apart from the upper surface of the first board 91, while making it possible to arrange a conductive trace such as a circuit pattern in the upper surface of the first board 91 at a region thereof located below the connecting bar 58. Furthermore, as shown in FIG. 12, the recessed groove portion 12 of the first housing 11 has the mounting surface thereof closed by the bottom plate part 17. Thus, the portion of the first terminal 61 except for the first tail portion 62 does not come into contact with the upper surface of the first board 91. It is thus possible to arrange a conductive trace such as a circuit pattern in almost the entire region of the upper surface of the first board 91 confronting the lower portion of the first housing 11. This enhances the freedom in design of a conductive trace on the first board 91 and substantially reduces the mounting area necessary for mounting the first connector 1 on the first board 91, thereby enhancing the packaging density of electronic components or the like on the first board 91.

The afore-described second reinforcing metallic bracket 151 is attached to the second housing 111 by pinching, from both sides, the holding shoulder 124*a* of each bracket holding part 124 formed in the insertion plug portion 121 of the second housing 111 with the shoulder 152*a* of the second body part 152 and the holding projection 153*a* of the holding barrel portion 153. The bracket holding part 124 is a portion of the insertion plug portion 121, which is surrounded by the bracket receiving receptacle portion 123. That is, upon mounting of the second reinforcing metallic bracket 152 onto the second housing 111, the second body part 152 is moved from the fitting surface toward the second housing 111 and the holding barrel portion 153 is fitted to the inner receiving part 123*b* to complete the mounting of the second reinforcing metallic bracket 152.

In this way, the shoulder 152*a* is engaged with the holding shoulder 124*a* of the bracket holding part 124. Thus, even when a force to pull up the second housing 111 upward with respect to the second reinforcing metallic bracket 151 (in the downward direction in FIG. 10) is exerted, the second housing 111 does not come out of the second reinforcing metallic bracket 151. By connecting the second grounding part 156 of the second reinforcing metallic bracket 151 to the grounding pad on the second board 191 by soldering or the like, the second housing 111 is firmly and fixedly secured to the second board 191.

As shown in FIG. 11, in a state where the first connector 1 is mated to the second connector 101, the insertion plug portion 121 of the second housing 111 is inserted into the insertion receptacle portion 21 of the first housing 11, and the first locking part 54 of the first reinforcing metallic bracket 51 and the second locking part 154 of the second reinforcing metallic bracket 151 are engaged with each other to lock the first connector 1 and the second connector 101. More specifically, the first engaging projection 55 formed in a portion close to the free end of the first locking part 54 is engaged with the second engaging projection 155 of the second locking part 154. Therefore, the engagement of the first locking part 54 with the second locking part 154 can be firm and, as a result, fitting of the first connector 1 to the second connector 101 can be also firm.

Mutual contact between the first locking part 54 and the second locking part 154 provides electric conduction between the first reinforcing metallic bracket 51 and the second reinforcing metallic bracket 151. This provides electric continuity between the grounding trace connected to the grounding pad on the first board 91 to which the first grounding part 56 of the first reinforcing metallic bracket 51 is connected and the grounding trace connected to the grounding pad on the second board 191 to which the second grounding part 156 of the second reinforcing metallic bracket 151 is connected. Hence, the grounding trace on the first board 91 and the grounding trace on the second board 191 are brought about to have the same electric potential via the first reinforcing metallic bracket 51 and the second reinforcing metallic bracket 151. This eliminates a need to separately arrange a grounding terminal on each of the first connector 1 and the second connector 101. Therefore, it is possible to downsize the first connector 1 and the second connector 101 as well as to reduce the manufacturing cost of the first connector 1 and the second connector 101.

In a state where the first connector 1 is mated to the second connector 101, the first engaging projection 55 of the first locking part 54 of the first reinforcing metallic bracket 51 is outwardly pressed by the second locking part 154 of the second reinforcing metallic bracket 151 and thus receives an outward force, that is, a force urging the second locking part 154 towards the end side wall part 22 of the first housing 11. This applies a turning moment to the first body part 52 including the first locking part 54 in a direction where the free end of the first locking part 54 approaches the end side wall part 22. The turning moment is exerted in a direction the holding arm part 53 moves away from the outer wall surface of the bracket holding part 24 with respect to the holding arm part 53.

The holding arm part 53 is integral with the first grounding part 56 and has an L-shaped side surface. The lower surface of the first grounding part 56 is flat and thus comes into contact with the grounding pad on the first board 91 even in the connecting part for the holding arm part 53. Thus, the turning moment is received by the grounding pad with which the lower surface of the first grounding part 56 is in contact while being hardly exerted on the holding arm part 53. As a result, the holding arm part 53 is not displaced by the turning moment in a direction in which the holding arm part 53 is moved away from the outer wall surface of the bracket holding part 24. The holding projection 53*a* of the holding arm part 53 remains engaged into and gripping in the outer wall surface of the bracket holding part 24, thus firmly holding the bracket holding part 24 and firmly fixedly securing the first housing 11 to the first board 91.

While being pressed by the second locking part 154 of the second reinforcing metallic bracket 151, the first locking part 54 per se is elastically displaced so as to tilt in a direction approaching the end side wall part 22. This displaces the holding projection 54*a* in a direction approaching the bracket holding part 24 and increasing the amount of engagement with the holding shoulder 24*a*. This in turn holds the bracket holding part 24 more firmly thereby fixedly securing the first housing 11 to the first board 91.

Furthermore, with regard to the turning moments acting on the respective first body parts 52, those exerted on the right and left first body parts 52 are in directions opposite to each other. In reality, the right and left first body parts 52 are, however, connected to each other by the connecting bar 58. Thus, the turning moments which are exerted on the right and left first body parts 52 act in directions enabling mutual cancellation and are substantially attenuated. Accordingly, an increase in the strength of the right and left first body parts 52 is brought about and provides a larger fitting force, thereby assuring an enhanced fitting force between the first connector 1 and the second connector 101.

In the illustrated example, the connecting bar 58 is connected to the first locking part 54 in an area located above the connecting point between the first locking part 54 and the first grounding part 56 as a fulcrum of displacement of the first locking part 54, that is, in an area located closer to the first engagement projection 55 as a point of application of the force from the second locking part 154. It is thus possible to more effectively suppress the displacement of the first locking part 54. In addition, a repulsion of the first locking part 54 exhibited by a displacement thereof increases. This provides enhanced engagement between the second reinforcing metallic bracket 151 and the second locking part 154 and accordingly, enhanced fitting between the first connector 1 and the second connector 101.

As described before, the connecting bar 58 has a convex portion 58*a* protruding downward from the lower surface integrally formed thereon. It is thus possible to adjust the strength of the connecting bar 58 by adjusting the number, arrangement, and size of the convex portions 58*a*. This adjusts the repulsion of the right and left first locking parts 54 exhibited by the displacement thereof thus adjusting a force for the engagement of the first locking part 54 with the corresponding second locking part 154 of the second reinforcing metallic bracket 151.

The convex portion 58*a* may be formed to protrude upward from the upper surface of the connecting bar 58. However, as will be understood from FIG. 11, in a state where the first connector 1 and the second connector 101 are mated together, the second reinforcing metallic bracket 151 is close to the upper surface of the connecting bar 58 thus leaving a limited space above the connecting bar 58. It is, therefore, preferable to form the convex portion or portions 58*a* to protrude downward from the lower surface of the connecting bar 58. In case a grounding pad is formed also in a region of the upper surface of the first board 91 confronting the lower portion of the connecting bar 58, it is possible to allow the convex portion 58*a* to protrude further downwardly so that the lower end surface of the convex portion 58*a* is able to come into contact with a grounding pad and connect thereto by means of soldering or the like. In this case, the strength of the connecting bar 58 may be dramatically enhanced, thus ensuring extremely firm fitting of the first connector 1 to the second connector 101.

As shown in FIG. 12, the first terminals 61 are inserted in the first terminal receiving cavities 15 and the first terminal receiving grooves 16 of the first housing 11 from the fitting surface, and the first retention portion 63 is pinched by the side walls 16*a* of the first terminal receiving groove 16 from both sides thus attached to the first housing 11.

The connecting parts 64 are accommodated in the first terminal receiving cavities 15 and the first terminal receiving grooves 16 in the recessed groove portion 12. The tip of the first contact portion 65 formed near the free end of the connecting part 64 protrudes from the first terminal receiving cavities 15. The recessed groove portion 12 has its mounting surface closed by the bottom plate part 17, so that the connecting part 64 does not come into contact with the upper surface of the first board 91.

The first tail portion 62 of the first terminal 61 is connected by means of soldering or the like to the connection pad coupled to the conductive trace on the first board 91. The tip of the first tail portion 62 is positioned inward from the outer surface of the side wall part 14. That is, the first tail portion 62 does not protrude outside the outer surface of the wide wall part 14. This makes it possible to reduce the dimension of the first connector 1 in its width direction and the width of a mounting surface necessary for mounting the first connector 1 on the first board 91.

The second terminals 161 are inserted into the second terminal receiving grooves 116 of the second housing 111 from the fitting surface, and the second retention portion 163 is pinched by the side walls 116*a* of the second terminal receiving groove 116 from both sides thus attached to the second housing 111. The second contact portion 165 is accommodated in the second terminal receiving grooves 116 in the recessed grooved portion 113. The second tail portion 162 of the second terminal 161 is also connected by means of soldering or the like to the connection pad coupled to the conductive trace on the second board 191.

Figure 13:
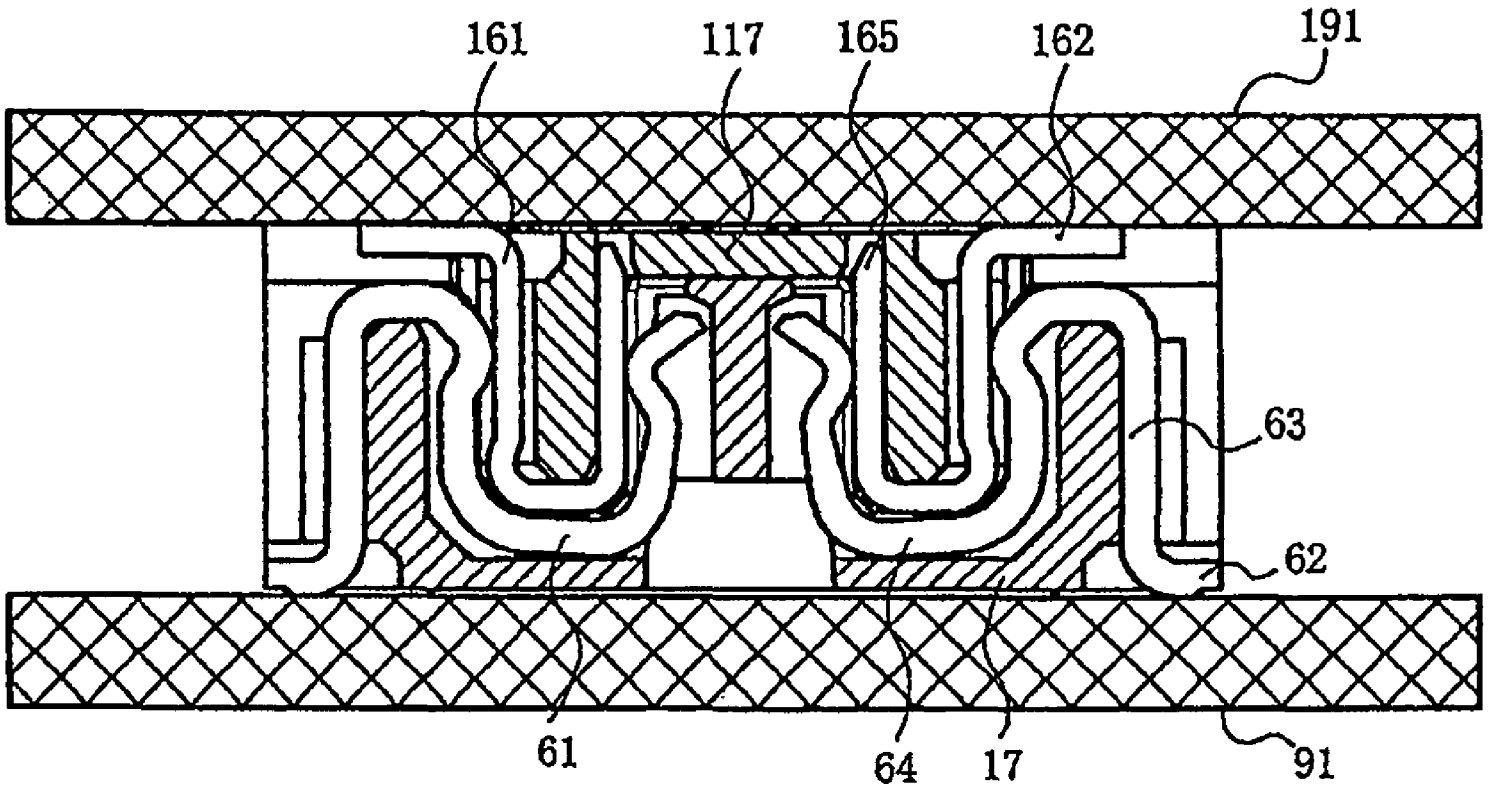
FIG. 13 is a cross-sectional view of the first connector and the second connector similar to FIG. 12 but with the connectors mated together.
Figure 14:
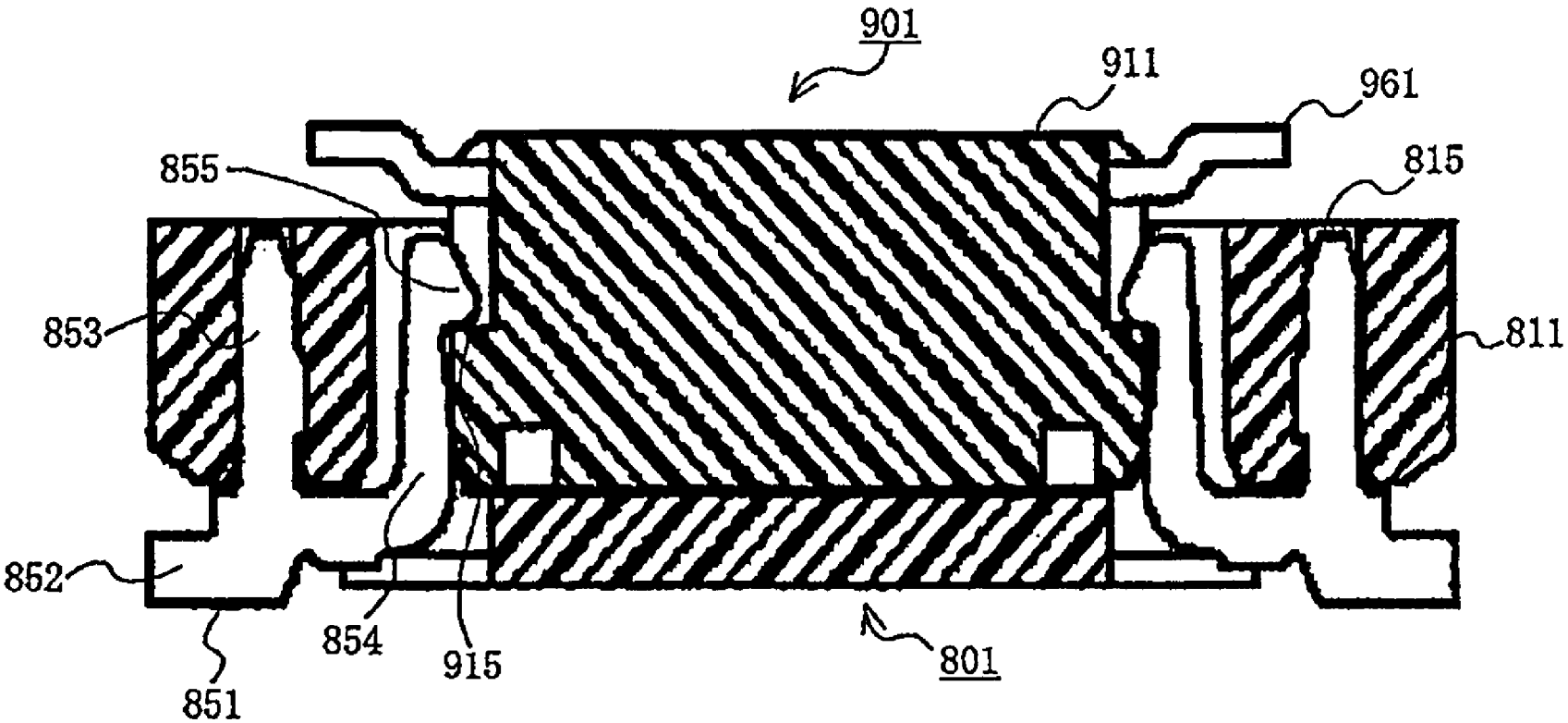
Prior art FIG. 14
FIG. 14 is a cross-sectional view of the reinforcing metallic bracket of a conventional board-to-board connector.

As shown in FIG. 13, in a state where the first connector 1 is mated to the second connector 101, the protruding portion 112 of the second housing 111 is inserted into the recessed groove portion 12 of the first housing 11 and the tip of the first contact portion 65 of the first terminal 61 comes into contact with the second contact portion 165 of the second terminal 161. This provides electric conduction between the first terminal 61 and the second terminal 161. This further provides electric conduction between the conductive trace connected to the connection pad on the first board 91 to which the first tail portion 62 of the first terminal 61 is connected and the conductive trace connected to the connection pad on the second board 191 to which the second tail portion 162 of the second terminal 161 is connected.

From the foregoing, it will be understood that in the present embodiment of the present invention, the first reinforcing metallic bracket 51 includes first body parts 52 respectively attached to the end side wall parts 22 on the opposite sides of the insertion receptacle portion 21 and a connecting member 58 for connecting the first body parts 52 on both sides. The first body part 52 includes a first locking part 54 to come into contact with and engage with the second locking part 154 of the second reinforcing metallic bracket 151 and a first grounding part 56 to be connected to the first board 91 thereby being grounded.

This enhances the strength of the first body parts 52 on both sides and the fitting force of the first reinforcing metallic brackets 51. The first reinforcing metallic brackets 51 and the second reinforcing metallic brackets 151 exhibit a sufficiently strong locking force, which secures fitting of the first connector 1 to the second connector 101. The first reinforcing metallic brackets 51 are strong so that the reinforcing metallic brackets 51 do not come off the first connector 1 thus enhancing reliability. The first reinforcing metallic brackets 51 also serve as grounding terminals, thus eliminating the need for providing separate grounding terminals and downsizing the first connector 1 and the second connector 101 as well as reducing the corresponding cost.

The first body part 52 includes a holding arm part 53 connected to one end of the first grounding part 56. The holding arm part 53 pinches, together with the first locking part 54 connected to one end of the first grounding part 56, the bracket holding part 24 formed at the lower end of the end side wall part 22 of the first housing 11 from both sides. Thus, the end side wall part 22 is not removed from the first reinforcing metallic bracket 51.

The connecting bar 58 includes the convex portion or portions 58*a* protruding downward. This enhances the strength of the connecting bar 58.

The present invention is not limited to the above-described embodiments, and may be changed in various ways based on the gist of the present invention, and these changes are not eliminated from the scope of the present invention.

What is claimed is:

1. A board-to-board connector pair, comprising:

a first connector, the first connector including including:

a first housing of a substantially rectangular shape, the first housing including a pair of spaced apart first sidewalls defining an elongated insertion receptacle with a central projection therein, a plurality of first terminal receiving cavities, each first terminal receiving cavity being spaced along the first housing, and a first lock receiving cavity at each end of the first housing, a plurality of first terminals, each first terminal being mounted in a respective first terminal receiving cavity, and a first reinforcing locking bracket, the first reinforcing locking bracket being mounted in each first lock receiving cavities; and a second connector, the second connector being adapted for mating with the first connector and including:

a second housing of a substantially rectangular shape, the second housing including a pair of spaced apart second sidewalls defining an elongated channel therebetween, the elongated channel being configured to receive the central projection therein, a plurality of second terminal receiving cavities, each second terminal receiving cavity being spaced along the second housing, and a second lock receiving cavity at each end of the second housing, a plurality of second terminals, each second terminal being mounted in a respective second terminal receiving cavity and being configured to operatively mate with one of the first terminals, and a second reinforcing locking bracket, the second reinforcing locking bracket being mounted in each second lock receiving cavities;

wherein:

the first reinforcing locking brackets are planar members stamped from sheet metal and include a pair of first body parts, each first body part including a deflectable first locking arm and a first board mounting part for mounting to a first circuit member and being positioned on opposite sides of the insertion receptacle and secured to one of the sidewalls, and a relatively narrow and deflectable connecting member interconnecting the first body parts; and the second reinforcing locking brackets are planar members stamped from sheet metal and include a pair of locking parts, a bracket retention section for securing the second locking bracket to the second housing, and a second board mounting part for mounting to a second circuit member, each locking part being configured to lockingly engage one of the first locking arms to assist in securing the first and second connectors together.

2. The board-to-board connector pair according to claim 1, wherein the connecting member includes at least one projecting portion extending downward from an edge thereof.

3. The board-to-board connector pair according to claim 1, wherein the connecting member includes at least two spaced apart projecting portions extending downward from a lower edge thereof.

4. The board-to-board connector pair according to claim 1, wherein each first body part further includes a first retention part connected to one end of the first mounting part.

5. The board-to-board connector pair according to claim 4, wherein the retention part and a portion of the first locking arm engage opposite sides of one of the first sidewalls.

6. The board-to-board connector pair according to claim 5, wherein the first retention part and the portion of the first locking arm that engage opposite sides of one of the first sidewalls does so at a location spaced inwardly from an outside edge of the first sidewall.

7. The board-to-board connector pair according to claim 5, wherein the first retention part includes a holding projection protruding in a direction toward one of the locking parts.

8. The board-to-board connector pair according to claim 7, wherein one of the locking parts includes a lock projection protruding in a direction toward the first retention part.

9. The board-to-board connector pair according to claim 8, wherein the first locking arm engages the other locking part.

10. The board-to-board connector pair according to claim 9, wherein one of the locking parts further includes a first engaging projection formed at a position closer to a free end thereof than the lock projection.

11. The board-to-board connector pair according to claim 10, wherein such first engaging projection protrudes in a direction opposite the holding projection, and is engaged with one of the second locking brackets.

12. The board-to-board connector pair according to claim 1, wherein each of the first and second connectors has a longitudinal axis.

13. The board-to-board connector pair according to claim 12, wherein the first and second reinforcing locking brackets mate together in a plane having a thickness as thick as the sheet metal from which the first and second reinforcing locking brackets are stamped.

14. The board-to-board connector pair according to claim 12, wherein each of the first and second reinforcing locking brackets have a thickness along the longitudinal axis, the thickness being as thick as the sheet metal from which the first and second reinforcing locking brackets are stamped.

15. The board-to-board connector pair according to claim 1, wherein each first terminal is spaced along the insertion receptacle.

16. The board-to-board connector pair according to claim 15, wherein each second terminal is spaced along the channel.

17. The board-to-board connector pair according to claim 1, wherein each locking part includes a deflectable arm.

18. The board-to-board connector pair according to claim 17, wherein the bracket retention section extends through a central bore between the sidewalls of the second connector.

* * * * *